US010682540B2

(12) United States Patent
Mantione, III

(10) Patent No.: US 10,682,540 B2
(45) Date of Patent: Jun. 16, 2020

(54) EXERCISE EQUIPMENT AND METHOD

(71) Applicant: Jack Michael Mantione, III, New York, NY (US)

(72) Inventor: Jack Michael Mantione, III, New York, NY (US)

( * ) Notice: Subject to any disclaimer, the term of this patent is extended or adjusted under 35 U.S.C. 154(b) by 44 days.

(21) Appl. No.: 16/157,931

(22) Filed: Oct. 11, 2018

(65) Prior Publication Data

US 2019/0314666 A1 Oct. 17, 2019

Related U.S. Application Data

(63) Continuation-in-part of application No. 29/647,650, filed on May 15, 2018, now Pat. No. Des. 860,341,
(Continued)

(51) Int. Cl.

| | |
|---|---|
| ***A63B 21/04*** | (2006.01) |
| ***A63B 21/055*** | (2006.01) |
| ***A63B 21/00*** | (2006.01) |
| ***A63B 21/16*** | (2006.01) |
| ***A63B 23/12*** | (2006.01) |

(Continued)

(52) U.S. Cl.

CPC ..... *A63B 21/0442* (2013.01); *A63B 21/026* (2013.01); *A63B 21/0555* (2013.01); *A63B 21/0557* (2013.01); *A63B 21/1645* (2013.01); *A63B 21/1654* (2013.01); *A63B 21/1663* (2013.01); *A63B 21/4035* (2015.10); *A63B 23/1209* (2013.01); *A63B 71/0054* (2013.01);
(Continued)

(58) Field of Classification Search

CPC ..... A63B 21/0442; A63B 21/0555; A63B 21/4035; A63B 21/0557; A63B 21/1654; A63B 23/1209; A63B 21/1663; A63B 21/1645; A63B 21/026; A63B 71/0054; A63B 2210/00; A63B 2209/00; A63B 1/00

See application file for complete search history.

(56) References Cited

U.S. PATENT DOCUMENTS 1,421,198 A * 6/1922 Fidora ..... A63B 21/05 482/126
D232,368 S * 8/1974 Grant ..... D21/692
(Continued)

*Primary Examiner* — Garrett K Atkinson
(74) *Attorney, Agent, or Firm* — Cameron LLP

(57) ABSTRACT

Exercise equipment for at least pulling and pushing exercises comprises an elastic tubular band covered by a flexible material covering, for example, of nylon which is threaded through an O-ring grommet and holes in first and second straps threaded through first and second handles proximate to one another when gripped by a user. The exercise equipment may be used with a safety door attachment that comprises a safety loop for looping around a door handle or knob. The safety loop is stitched to a loop threaded through a plastic spindle of a foam door stop used on one side of a closed door. A further loop extends from the plastic spindle to the other closed side of the door and is adapted to receive the exercise equipment through the further loop. A series of isometric pulling and pushing exercises, trunk rotation among other exercises are disclosed and various accessories which may be used for warm up, relieving pain and for exercise including a D-ring embodiment for use with known exercise equipment.

11 Claims, 16 Drawing Sheets

Related U.S. Application Data which is a continuation-in-part of application No. 29/643,786, filed on Apr. 11, 2018, now Pat. No. Des. 861,087, which is a continuation-in-part of application No. 29/643,789, filed on Apr. 11, 2018, which is a continuation-in-part of application No. 29/643,784, filed on Apr. 11, 2018, now Pat. No. Des. 864,319.

(51) Int. Cl.
*A63B 21/02* (2006.01)
*A63B 71/00* (2006.01)

(52) U.S. Cl.
CPC ..... *A63B 2209/00* (2013.01); *A63B 2210/00* (2013.01)

(56) References Cited

U.S. PATENT DOCUMENTS

D242,936 S * 1/1977 Docic ..... D21/693
4,057,246 A * 11/1977 Wilson ..... A63B 21/0552 482/125
4,059,265 A * 11/1977 Wieder ..... A63B 21/04 482/125
4,090,706 A * 5/1978 Reda ..... A63B 21/0004 482/122
4,204,674 A * 5/1980 Ogland ..... A63B 21/0004 482/131
4,211,405 A * 7/1980 Blowsky ..... A63B 21/00043 482/128
4,245,840 A * 1/1981 Van Housen ..... A63B 21/0004 24/115 H
4,257,592 A * 3/1981 Jones ..... A63B 21/154 24/115 K
D263,328 S * 3/1982 Cooper ..... D21/693
4,722,523 A * 2/1988 Yang ..... A63B 17/04 482/106
4,733,862 A * 3/1988 Miller ..... A63B 21/0552 24/129 R
4,753,434 A * 6/1988 Salvino ..... A63B 23/16 482/121
4,762,318 A * 8/1988 Phillips ..... A63B 21/0004 24/115 L
D301,271 S * 5/1989 Greenfeld ..... D21/692
4,865,316 A * 9/1989 Yeaman ..... A63B 21/00043 482/126
4,909,505 A * 3/1990 Tee ..... A63B 21/00043 482/121
D311,232 S * 10/1990 Drennan ..... D21/692
5,236,405 A * 8/1993 Dohmann ..... A63B 5/20 482/81
5,261,864 A * 11/1993 Fitzpatrick ..... A63B 21/0552 482/123
D343,881 S * 2/1994 Wilson ..... D21/662
D346,632 S * 5/1994 Castellanos ..... D21/692
5,360,385 A * 11/1994 Wang ..... A63B 23/16 482/126
5,499,961 A * 3/1996 Mattox ..... A63B 21/055 482/123
5,512,028 A * 4/1996 Sparks, III ..... A63B 21/0004 446/253
D374,518 S * 10/1996 McIntyre ..... D21/694
5,620,397 A * 4/1997 Chieh ..... A63B 5/20 482/121
5,637,066 A * 6/1997 Chang ..... A63B 21/0004 482/121
5,643,159 A * 7/1997 Iavarone ..... A63B 21/0004 482/125
5,800,322 A * 9/1998 Block ..... A63B 21/0004 482/126
5,842,956 A * 12/1998 Strachan ..... A63B 5/20 482/82
5,857,945 A 1/1999 Papp et al.
5,871,423 A * 2/1999 Pruchnik ..... A63B 21/22 482/1
D406,287 S * 3/1999 Carver ..... D21/662
6,071,218 A * 6/2000 Tepperberg ..... A63B 21/0004 482/121
6,338,702 B1 * 1/2002 Jordan ..... A63B 21/072 294/15
D455,185 S * 4/2002 Karadimas ..... D21/692
6,450,929 B1 * 9/2002 Markham ..... A63B 21/0552 482/121
6,517,470 B1 * 2/2003 Chak ..... A63B 21/0004 482/121
6,551,222 B1 * 4/2003 Beaver ..... A63B 5/20 482/82
6,558,301 B1 * 5/2003 Jackson ..... A63B 21/0552 482/121
6,620,082 B1 * 9/2003 Siegel ..... A63B 21/0004 482/124
6,648,804 B2 * 11/2003 Chen ..... A63B 21/0004 482/125
6,672,997 B1 * 1/2004 Winkler ..... A63B 21/0552 482/121
6,692,415 B1 * 2/2004 Winston ..... A63B 21/0004 482/122
D489,422 S * 5/2004 Feder ..... D21/662
6,921,354 B1 * 7/2005 Shifferaw ..... A63B 21/068 482/126
7,128,699 B2 * 10/2006 Hsu ..... A63B 21/0004 482/125
7,137,935 B2 * 11/2006 Clarke ..... A63B 21/00043 482/123
7,175,574 B2 * 2/2007 Carmel ..... A63B 21/0004 482/124
7,192,390 B2 * 3/2007 Berard ..... A63B 21/0004 482/121
7,322,907 B2 * 1/2008 Bowser ..... A63B 21/04 482/121
7,326,157 B2 * 2/2008 Wu ..... A63B 21/0004 482/121
7,344,484 B1 * 3/2008 Porcellato ..... A47C 7/62 482/123
7,344,485 B1 * 3/2008 Simpson ..... A63B 21/0004 482/121
7,387,599 B1 * 6/2008 Hsu ..... A61H 15/0092 482/122
7,410,450 B1 * 8/2008 Paulding ..... A63B 21/0552 482/120
7,455,632 B2 * 11/2008 Block ..... A63B 21/0004 482/121
7,503,883 B2 * 3/2009 Madden ..... A63B 21/0004 482/121
7,524,271 B2 * 4/2009 Bendavid ..... A63B 21/0552 297/217.1
D593,167 S * 5/2009 Vigilia ..... D21/662
7,601,107 B2 * 10/2009 Maloy ..... A63B 23/1209 482/123
7,611,450 B2 * 11/2009 Mancini ..... A63B 21/04 482/123
7,625,324 B1 * 12/2009 Hinds ..... A63B 21/4017 482/121
7,628,735 B1 * 12/2009 Hsu ..... A63B 5/20 482/108
7,628,742 B2 * 12/2009 Weaver ..... A63B 21/0004 482/124
7,641,604 B2 * 1/2010 Blount ..... A63B 21/4019 482/139
7,699,761 B1 * 4/2010 Dieter ..... A63B 23/04 482/124
7,749,140 B1 * 7/2010 Lindemeier ..... A63B 21/4017 482/126
7,785,244 B2 * 8/2010 Hetrick ..... A63B 21/4017 482/139
7,794,374 B1 * 9/2010 Park ..... A63B 21/0004 482/122
7,871,359 B2 * 1/2011 Humble ..... A63B 21/153 242/375.1

(56) References Cited

U.S. PATENT DOCUMENTS 7,892,157 B2 * 2/2011 Arnett ..... A63B 21/068 482/131
D636,036 S * 4/2011 Rios ..... D21/662
D644,280 S * 8/2011 Marotta ..... D21/662
7,998,034 B1 * 8/2011 Cobo ..... A63B 69/0028 482/126
8,016,335 B2 * 9/2011 McKay ..... A62B 35/0006 294/141
8,043,197 B2 * 10/2011 Hetrick ..... A63B 21/0023 482/91
D654,124 S * 2/2012 Davis ..... D21/662
D657,008 S * 4/2012 Markovic ..... D21/662
8,162,809 B1 * 4/2012 Eastwood ..... A63B 21/0552 482/123
D666,256 S * 8/2012 Wine ..... D21/662
8,303,473 B2 * 11/2012 Gutierrez ..... A63B 21/00 482/121
8,317,667 B1 * 11/2012 Thomas ..... A63B 21/0555 482/121
D674,448 S * 1/2013 Puig ..... D21/662
D678,434 S * 3/2013 Hughes ..... D21/662
8,602,951 B2 * 12/2013 Morris ..... A63B 21/0004 403/202
8,678,983 B1 * 3/2014 Brown ..... A63B 21/4033 482/131
D711,986 S * 8/2014 Russotti ..... D21/694
8,858,408 B2 * 10/2014 DeMeo ..... A63B 21/00185 482/131
8,870,722 B2 * 10/2014 Kassel ..... A63B 21/0552 482/121
8,876,678 B2 * 11/2014 Flentye ..... A63B 21/0552 482/121
8,882,642 B2 * 11/2014 Chavez ..... A63B 21/0442 482/121
8,894,556 B2 * 11/2014 Webb ..... A63B 21/062 482/139
D719,303 S * 12/2014 Anderson ..... D29/124
8,905,904 B2 * 12/2014 Carter ..... A63B 21/153 482/129
8,920,293 B1 * 12/2014 Rosaly ..... A63B 21/0555 482/121
8,944,973 B2 * 2/2015 Lalaoua ..... A63B 21/02 482/121
8,944,975 B2 * 2/2015 Hsieh ..... A63B 21/0442 482/124
8,961,378 B2 * 2/2015 Holland ..... A63B 21/00065 482/126
8,961,379 B2 * 2/2015 Flentye ..... A63B 21/0552 482/121
8,986,173 B1 * 3/2015 Adams ..... A63B 21/028 482/106
D726,841 S * 4/2015 Wright ..... D21/662
8,998,779 B1 * 4/2015 Ihli ..... A63B 21/00185 482/115
8,998,780 B2 * 4/2015 Lewen ..... A63B 7/02 482/124
9,050,484 B2 * 6/2015 Flentye ..... A63B 23/0355
9,333,143 B2 * 5/2016 Weber ..... A61H 1/02
9,333,386 B2 * 5/2016 Alazet ..... A63B 21/0552
9,370,685 B2 * 6/2016 Watry ..... A63B 69/0093
9,586,074 B2 * 3/2017 Autogue ..... A63B 23/0355
9,592,418 B2 * 3/2017 Burrell ..... A63B 21/0552
9,597,541 B2 * 3/2017 Hinds ..... A63B 7/00
D798,972 S * 10/2017 Wallace ..... D21/692
9,808,665 B1 * 11/2017 Demarais ..... A63B 21/4035
9,914,010 B2 * 3/2018 Gutierrez ..... A63B 21/0442
10,112,072 B2 * 10/2018 Burrell ..... A63B 21/00061
D839,947 S * 2/2019 Cunningham ..... D16/237
D848,774 S * 5/2019 Owen ..... D6/716.6
2004/0180767 A1 * 9/2004 Carmel ..... A63B 21/0004 482/126
2005/0037904 A1 * 2/2005 Chang ..... A63B 21/00043 482/122
2005/0075223 A1 * 4/2005 Wu ..... A63B 21/0004 482/126
2006/0073954 A1 * 4/2006 Block ..... A63B 21/0004 482/121
2007/0155600 A1 * 7/2007 Cunningham ..... A63B 21/0004 482/126
2011/0098159 A1 * 4/2011 Wiseman ..... A63B 21/0552 482/108
2011/0237410 A1 9/2011 Perez
2013/0143724 A1 * 6/2013 DeMeo ..... A63B 21/00185 482/131
2014/0051555 A1 * 2/2014 Flentye ..... A63B 21/0552 482/121
2014/0051558 A1 * 2/2014 Flentye ..... A63B 21/0552 482/139
2014/0051559 A1 * 2/2014 Flentye ..... A63B 23/0355 482/139

* cited by examiner

EXERCISE EQUIPMENT AND METHOD

This application claims the right of priority to related U. S. Ornamental Design Patent Application Ser. No.s 29/643,784; 29/643,786; 29/643,789, filed Apr. 11, 2018 and 29/647,650 filed Apr. 15, 2018, directed to designs of exercise equipment and by the same inventor, Jack Michael Mantione III, all incorporated by reference as to their entire contents.

BACKGROUND OF THE ART

Field of the Invention

The present invention has to do with, and relates to, the general field of exercise equipment and method and, more particularly, to the improvement of exercise equipment involving first and second handles at each distal end of an elastic tubing and covering material, for example, nylon material such that when used with a door or wall attachment, statically or dynamically, both shoulder rotator cuff and scapular muscles such that these and core body muscles' strength improve with isometric stretching exercises involving simultaneously and firmly gripping the pairs of double handles with one or both hands while stretching the elastic tubing to its extent limited by the covering material. One may also exercise using just one hand, arm, shoulder and the torso using the double handle concept comprising a single elastic tubing and double grip-able handles. Also, described is a method of manufacture, and an exercise method may involve a semi-cylindrical cross-sectional body support and a pair of stretchable loops of varying thickness to further strengthen core body muscles.

Background

The present invention and patent application concern advances in the science of exercise equipment, to wit: aspects of use of a stretchable elastic tubing with a covering of, for example, nylon material to limit the stretch of the tubing having pairs of handles at each distal end of the elastic cord. Prior art devices are known and involve single handles at each end of an elastic band or cord. Exemplary prior art materials will now be introduced including non-patent material articles directed to the relationship between grip strength, the wrist, elbow, shoulder and scapular muscles of the body torso.

Alizadehkhaiyat, Omid et al., "Shoulder Muscle Activation and Fatigue During a Controlled Forceful Handgrip Task," *Journal of Electromyography and Kinesiology*, June, 2011, pp. 478-482, investigate the use of a hand grip task for the assessment of shoulder muscle activation. The controlled gripping task involved sixteen healthy control subjects at 50% of maximum voluntary contraction. A significant positive amplitude slope was found for both supraspinatus and infraspinatus, indicating that the grip task resulted in increasing muscle activity of key rotator cuff muscles.

Sathya, P. et al., "Correlation between Hand Grip Strength Power in Cricket Players," *International Journal of Science and Research,* 2014, postulated that all movements of the body either originate in or are coupled through the trunk, and this coupling action is created by a strong core, i.e. the torso. The spine is an important component of the kinematic chain, transferring force from the lower to the upper limits and functioning as a force generator capable of accelerating the arm. During both batting and bowling in cricket, hand grip plays the most important role for best performance and in other sports as well such as lawn tennis. A hand dynamometer with an adjustable grip comprising a single handle is the most valid and reliable tool to measure grip strength by squeezing the grip forcefully. In this study, while correlation is clear between hand grip strength and shoulder muscle strength, there was a weak correlation between hand grip strength and core muscle strength (using a single handle of the hand dynamometer).

U.S. Pat. No. 4,733,862, to Miller, provides a slider having three holes aligned vertically and parallel to one another whereby a flexible elastic band may be tied and captured by a first of the three holes of the slider. The elastic band is then threaded through a tubular handle (or grip) and then back through a second hole in the slider and out to another similar slider and handle combination. The length of the pair of handles and strength in units of force of the elastic band are variable. A pair of such tubular handles and sliders may be connected to the flexible elastic band for attachment to a wall or for standing and raising one's arms per FIG. 10. Each tubular handle at each distal end of the elastic band is free to rotate about the elastic band.

U.S. Pat. No. 5,800,322, to Block, substitutes the Miller slider and elastic band with a strip material having an overlapping section with aligned holes proximate a stretchable tube plugged at distal ends. The strip material loosely passes through a hand grip comprising a cylindrical tube that receives the strip material. The single cylindrical grip tube at each distal end is free to rotate about the strip material.

Resistance tubes and bands having single handles at each end are known available from www.prosourcefit.com where each handle comprises a plastic cylinder, and a strip material is stitched to a D clasp. The D clasp is then capable of being connected to a resistance band having a resistance between five and fifty pounds of stretching strength. Each single plastic handle has a foam cover which can promote gripping. A problem with one embodiment of such a device is the use of a carabiner. The carabiner may be used at each end of the resistance band to couple the resistance band to each handle at each distal end of the variable resistance elastic band via the D clasp. A problem with such a carabiner is that at least one serious injury is known involving a carabiner which became detached from a handle or a stretched elastic resistance band. The carabiner broke loose from the handle and the elastic band and hit the user in the eye.

Such resistance tubes and handles as discussed above may be used by attachment to a wall-mounted station such as the resistance band exercise station taught by Perez in U.S. Published Patent Application Publication 2011/0237410. A module connectable to a wall may comprise a plurality of front and side facing hooks for elastic band resistance tubes and single handles at each end of the tubes for use at any height on the wall.

U.S. Pat. No. 9,050,484, to Flentye, Herbert T. el al., discloses an exercise device and handle for same comprising an elongate member and a pair of handles, one handle at each distal end of the elongate member. An endless strap (the elongate member) between the handles comprises four elastic tubular bands that are braided together and each of the four elastic bands fits into a hole in a connector portion of a handle and are each stopped by respective bulbous ends. A loop comprising a material is looped through the connector and respective handle. Each distal handle comprises a grip having an inner tube of plastic and an outer tube of foam rubber so that the grip is adapted for movement about the loop and may be gripped tightly by a user.

None of the above prior art discloses or suggests a pair of hand grips at each end of an elastic tube covered in material for limiting stretch capable of strengthening shoulder muscles or muscles of the torso and for physical therapy injury rehabilitation healing purposes—such as a torn rotator cuff. On the other hand, U.S. Pat. No. 5,857,945 to Papp et al. shows exercise apparatus having a central interconnection housing to which may be attached elastic stretchable loops for use by the legs and the arms held by a harness of the upper body so that body core or torso muscles may be exercised by pulling on elastic straps tied to the interconnection housing. This complicated machine is capable of core body muscle exercise, but its use is very difficult for a user.

Simply put, there is no simple elastic band resistance tubing known in the art with double handles or double handles connectable to exercise equipment which promote shoulder muscular activity or exercise of muscles of the core body or torso. There remains a need in the art for a simple hand grip and elastic band that supports both shoulder and core body muscular activity as well as associated double handle accessories for use with exercise equipment known in the art.

SUMMARY OF THE PREFERRED EMBODIMENTS

An embodiment of the present invention extends, expands, and teaches new, useful, fun and successful stretching exercise equipment that comprises two handles juxtapositioned (side by side, at an angle to one another, or in line) so as to cause the user to squeeze the two handles (which may in one embodiment have different diameters) together to multiply the muscular activity of the wrist, hand and fingers to both increase grip strength but also actuate elbow muscles, shoulder muscles, scapular muscles and core muscles when used, for example, with a door attachment that may be safely deployed around a door handle or door knob and stopped from coming loose from a closed or inadvertently opened door when the door is used with the stretching exercise equipment and door attachment. As in Flentye, each of two hand grips may comprise a plastic cylindrical tube and a foam covering to permit squeezing. An embodiment of the present invention, as distinguished from Flentye, involves the use of first and second handles at each end of an elastic tubing covered by a, for example, nylon material to limit the degree of stretch of the elastic tubing so that the two handles may be gripped firmly together where each handle has a foam rubber cover.

Flentye, therefore, does not disclose or suggest firmly gripping two handles together with a user's hand to multiply muscular activity of the hand, wrist and fingers which firm gripping extends all the way to the torso. As will be explained further within, a user must grasp or squeeze both foam rubber covered handles of an embodiment of the present invention with their hands, the two handles forming a wider grip than a single handle alone. The handle pair causes the pair of handles at each end to compress and rotate together, and the foam rubber cover is compressed or squeezed as the dual handles are squeezed by each hand when the user stretches an elastic tubular band limited in stretch by, for example, a covering of a nylon material, the elastic tubular band passing through each handle along with the nylon material covering and plugged at each distal end. Each handle of the pair of handles at each distal end of the elastic tube and material has a foam rubber cover which when squeezed collapses and causes one handle to rotate with respect to the other when both handles are gripped. This squeezing has been found to cause rotation of the grips together, widens the grip in comparison to a single handle grip and multiplies the gripping force exerted by the user's wrist, hand and fingers further multiplying and involving the exercise of the forearm, elbow and shoulder rotator cuff and scapular muscles and extending the exercise to the core or torso muscles of a human body when used, for example in limited pushing and pulling.

For ease of use of the double handle at each distal end of loop stretching exercise equipment, a door attachment may comprise a first loop for wrapping around a door handle on one closing side of the door for safety purposes and a second loop stitched to the first loop which may reach to a central spindle of a cylindrical foam block as a block or stop for a further loop at the one side of the closed door. The loop passing through the closed door to the other side also passes through a hole formed by the central spindle at the central axis of the cylindrical foam block. A loop of varying length may reach around the side of the closed door to the stretching exercise equipment described above or to the bottom of the closed door or to the top of the closed door. Consequently, the door attachment to loop resistance exercise equipment having two grips at each distal end is safe because the door attachment is attached to the door handle as well as the spindle/foam cylinder and cannot break loose even if the cylindrical foam block were to break or the door accidentally be opened because the elastic loop will be stopped from hurting the user by its attachment to the door handle or knob.

A method of manufacture of a double handled stretching exercise equipment is disclosed involving straps having holes at each end that may be tied together by an O-ring metal grommet. The straps are of different lengths and the handles may be of different diameter. The strap widths may vary with the handle diameters. A material covering covers a stretchable elastic band which passes through each O-ring metal grommet. The material covering and elastic tubing are bent together and plugged by a plug to protect the tubing from breaking through the O-ring metal grommets.

A series of exercises is suggested for use with the exercise apparatus suggested above comprising a warm-up, a plurality of pulling holds, a plurality of pushing holds, rotation and reset from either the left or right side of the trunk, and extension and flexion of the wrist. Other exercises utilize elastic bands of different thickness and strength and a ball, similar to a lacrosse ball (for example, for alleviating tennis elbow or shoulder or back pain) can alleviate muscular pain. Further, a semi-cylindrical cross-section half foam roller body support may be used for certain bridging positions, for example, during warm up or during exercises and improve posture and shoulder movement.

The structure of the stretching exercise equipment, the door attachment and other exercise equipment as introduced above will be discussed as having the advantage of providing a sequence of exercises which strengthen the grip muscles of the hand, wrist and fingers, the muscles of the foream, elbow, shoulder, rotator cuff and scapular (shoulder blade) muscles as well as body core muscles. By limiting the degree of stretching, the exercises promote healing of body parts such as shoulder instability, shoulder impingement, torn rotator cuffs, elbow and wrist injuries as well as strengthening the torso, improve sports performance and stability and increase power in the tendons.

An embodiment of the present invention of stretching exercise equipment and associated apparatus, exemplary configurations and the like will be discussed with reference to the drawings, a brief description of which follows.

BRIEF DESCRIPTION OF THE DRAWINGS

FIG. 1A-1 is an expanded view of a circular portion of FIG. 1A labeled "SEE FIG. 1A-1" which comprises details of a plug for the rubber hose shown in FIG. 1B".

Figure 1A:
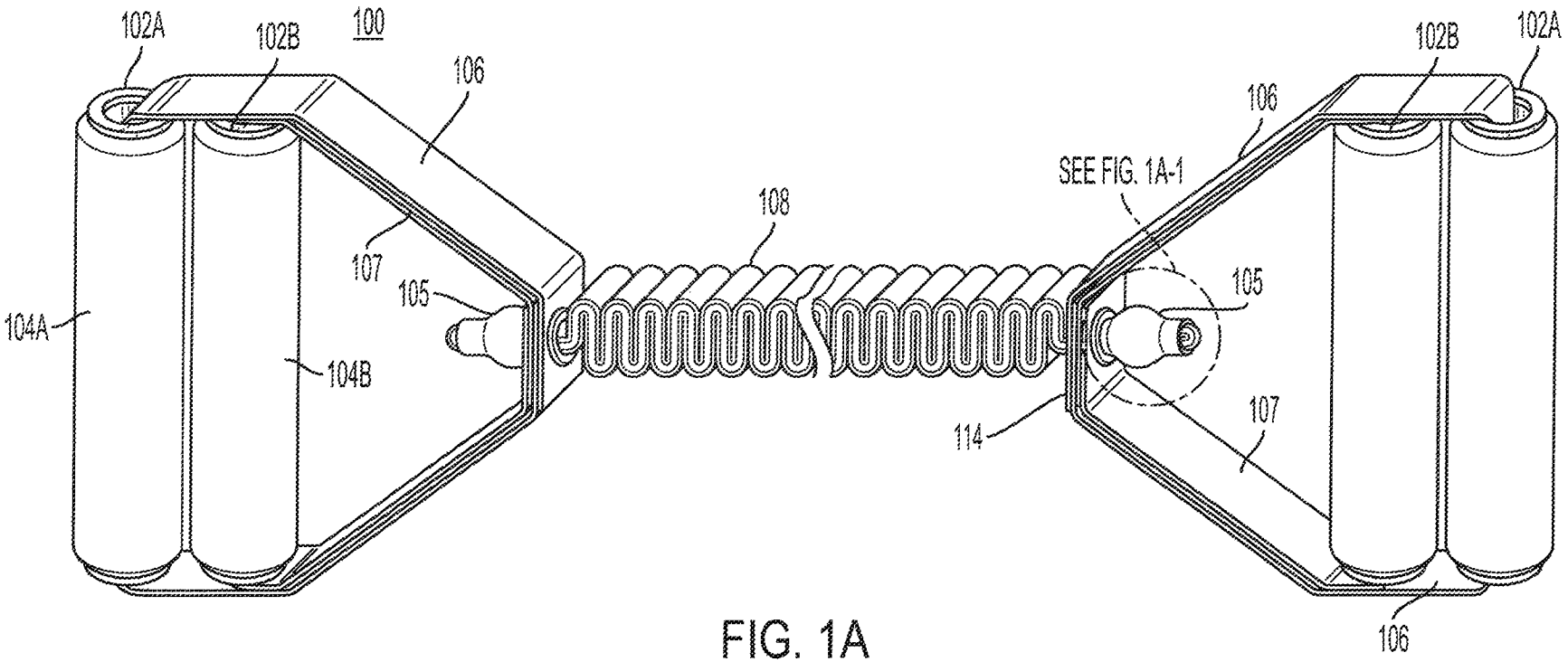
FIG. 1A includes a dashed line circle (see FIG. 1A-1) which provides details of a plug 105, an O-ring metal grommet 114 and elastic tubing 110 inside covering material 108 for limiting the stretch of the elastic tubing 110.
Figures 1, 1A:
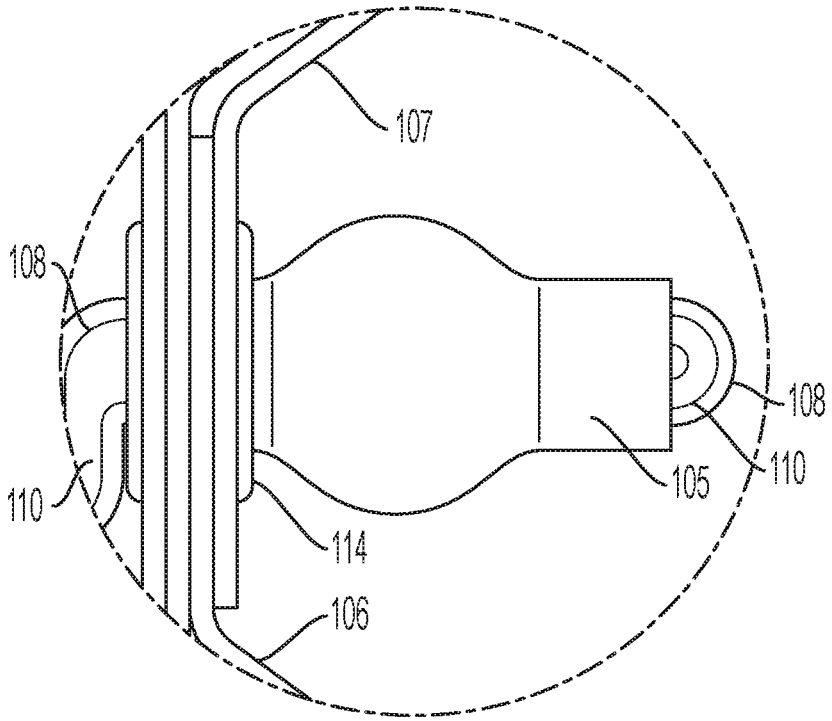
FIG. 1.A is a drawing of an embodiment of exercise equipment having double handles at each distal end of an elastic tubing 110 surrounded by a material covering 108 such as one made of nylon for limiting stretch of the elastic tubing. The double handles are shown in line with one another and may comprise different diameters or circumferences. As will be further described herein, the double handles will be out of alignment with one another and may even be orthogonal to the linear direction of the covering 108 and interior rubber tubing 110 held by plugs 105, The double handles may also be attached, for example, to a D-ring 115 for attachment to other exercise equipment as will be explained further herein. The elastic tubing 110 and covering material 108 may pass through a metal O-ring grommet 114 and holes in strap ends which strap passes through each handle of each pair of, for example, plastic cylindrical handles, each handle having a compressible foam rubber covering 104A, 104B, Users are encouraged to grip the double handles firmly.
Figure 3:
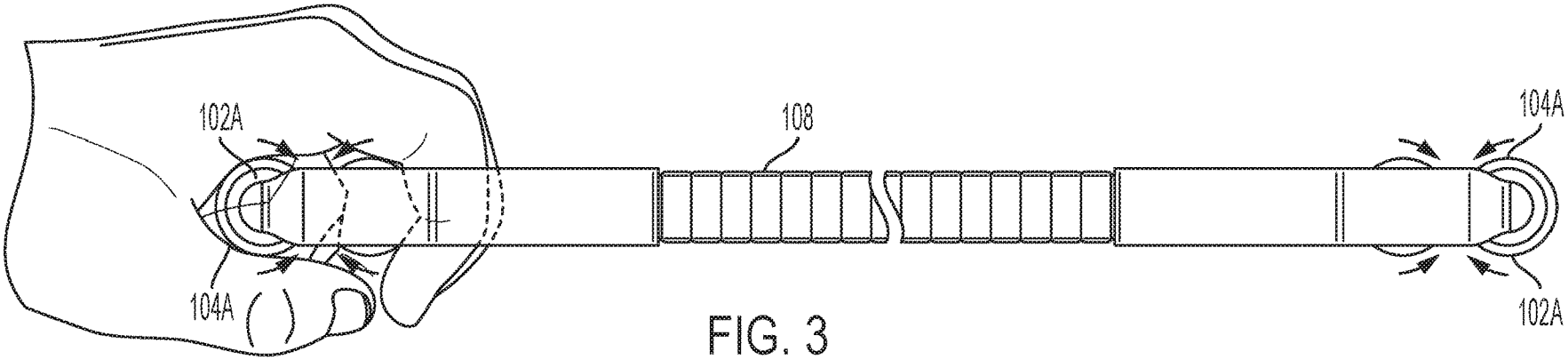

The hand shown in FIG. 3 in dashed line comprises a wrist, four fingers (shown from the side) and a thumb for gripping the two aligned handles of exercise equipment of FIG. 1A at each distal end together (one end shown with dashed line hand gripping the two equal diameter side-by-side handles—different diameter handles, not shown). When the hand grasps both handles, for example, at the left distal end, the thumb or fingers are required to form a wider grip than a prior art single handle and may compress the foam rubber cover of each cylinder handle together so that a left handle may rotate counter-clockwise and a right handle rotate clockwise (or vice versa). When the wrist and fingers are more actively gripping, the left handle may be squeezed against the right handle so that the left handle rotates clockwise while the right handle rotates counter-clockwise (or vice versa). The thumb may overlap the fingers or not (depending on the diameters of the double handles). Each of the two handles at each distal end may be sized for each user and range in diameter from 1.5 to 3.5 cm, for example, for young people having small hands to large people having large hands with 2.5 centimeters (one inch) being a typical diameter of a plastic cylindrical tube handle 102 for all users.

Figure 1B:
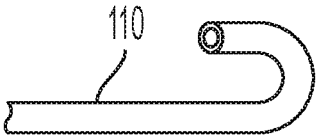
FIG. 1B is a drawing intended to show the elastic tubing 110 which may be designed to accommodate varying degrees of force such as from three pounds to fifty pounds of strength and may be approximately 1.25 centimeters diameter (within a range to 1.0 to 1.5 cm) and fits inside a typically material covering 108 such as nylon to limit extension of the tubing. The covering 108 limits the stretch of the elastic tubing 110, and covering 108 is seen in FIG. 1A. The tubing 110 may be covered by a covering 108. Straps 106 and 107 may be on either side of one another and a metal O ring 114 may seal and squeeze the rubber tubing 110 which may be folded with its cover 108 to be plugged as plug 105.
Figure 1C:
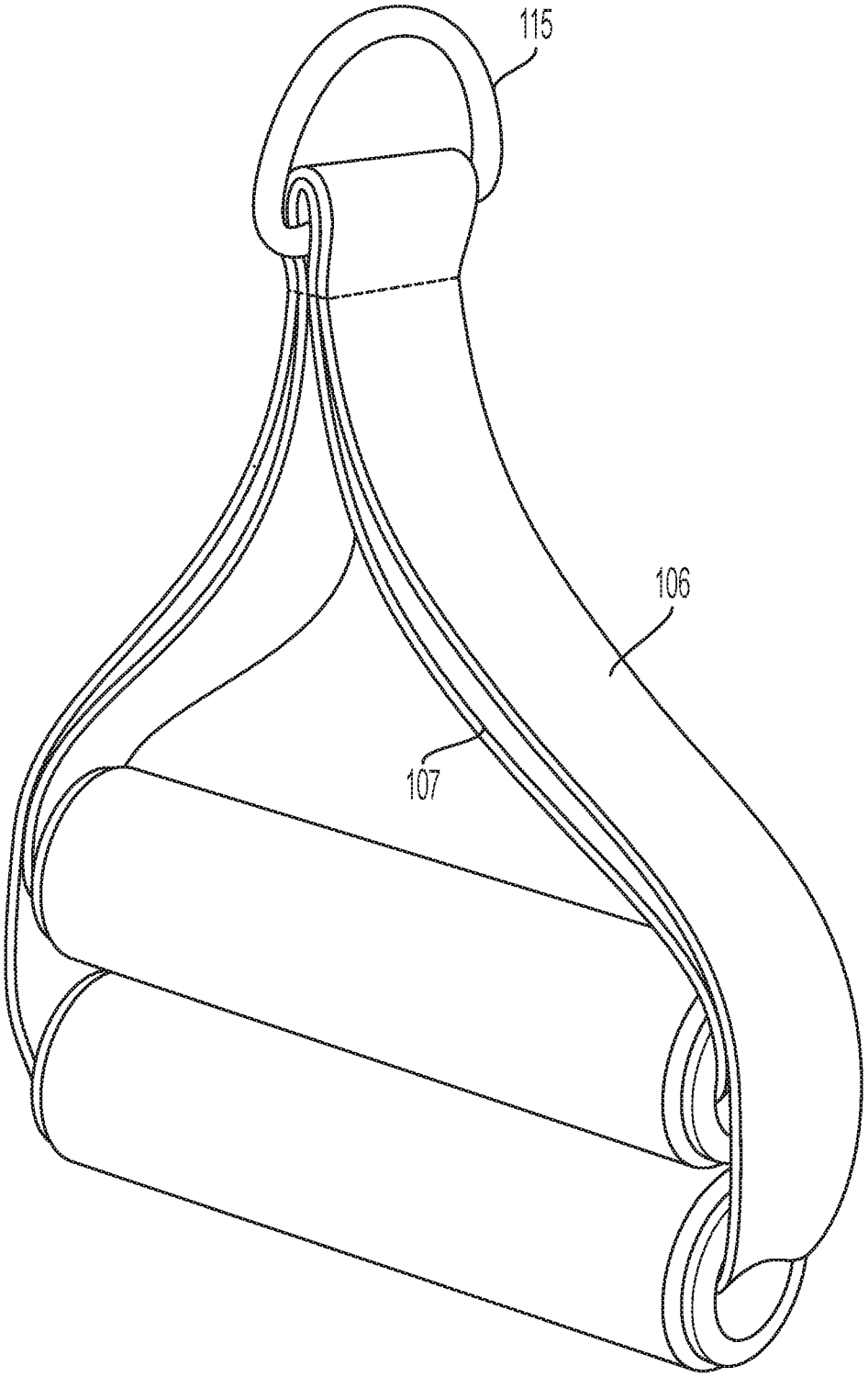
FIG. 1C shows detail of overlapping strap ends 106 and 107, a D-ring metal grommet 115 which is for attachment to other exercise equipment by, for example a carabiner, while plug 105 of FIG. 1A and overlapping material covering 108 and elastic tubing 110 bent over prevent rubber tubing 110 and covering 108 from pulling through the grommet 114.
Figure 2:
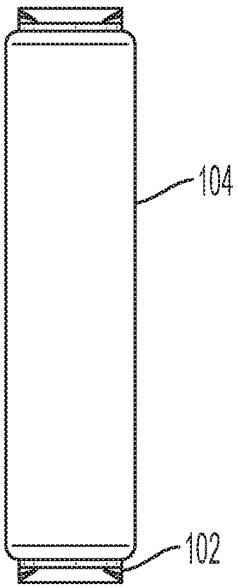
FIG. 2 is a drawing of an exemplary handle grip comprising a plastic (or related material) cylinder or tubular handle 102 and an outer covering 104 of, for example, foam rubber that compresses when gripped. Each handle may have a different diameter and may have a different tubular length to accommodate different sized grips of persons using the equipment, for example, handle 102 may be between three and six inches in length. Handle diameters may range from ½ inch to one inch.

FIG. 3 is a drawing showing a side view of the exercise equipment of FIGS. 1A, 1B and 1C showing a dashed line hand and wrist and fingers at left gripping two handles of FIG. 2 positioned side-by-side; (the handles may have different diameters in alternative embodiments; same diameter handles shown). As suggested above, the handles at one distal end may be of different diameter in alternative embodiments. The double-handled grip extends and strengthens the grip formed by the thumb and four fingers, wrist, elbow (not shown), shoulder (not shown), scapula (not shown) and activates muscles in the hand, wrist, forearm, elbow, shoulder, scapula and torso, multiplying the resistance capable over using a single grip handle known in the art. The covering material 108 limits the length of stretch of the elastic tubing 110 (FIG. 1B).

Figure 4:
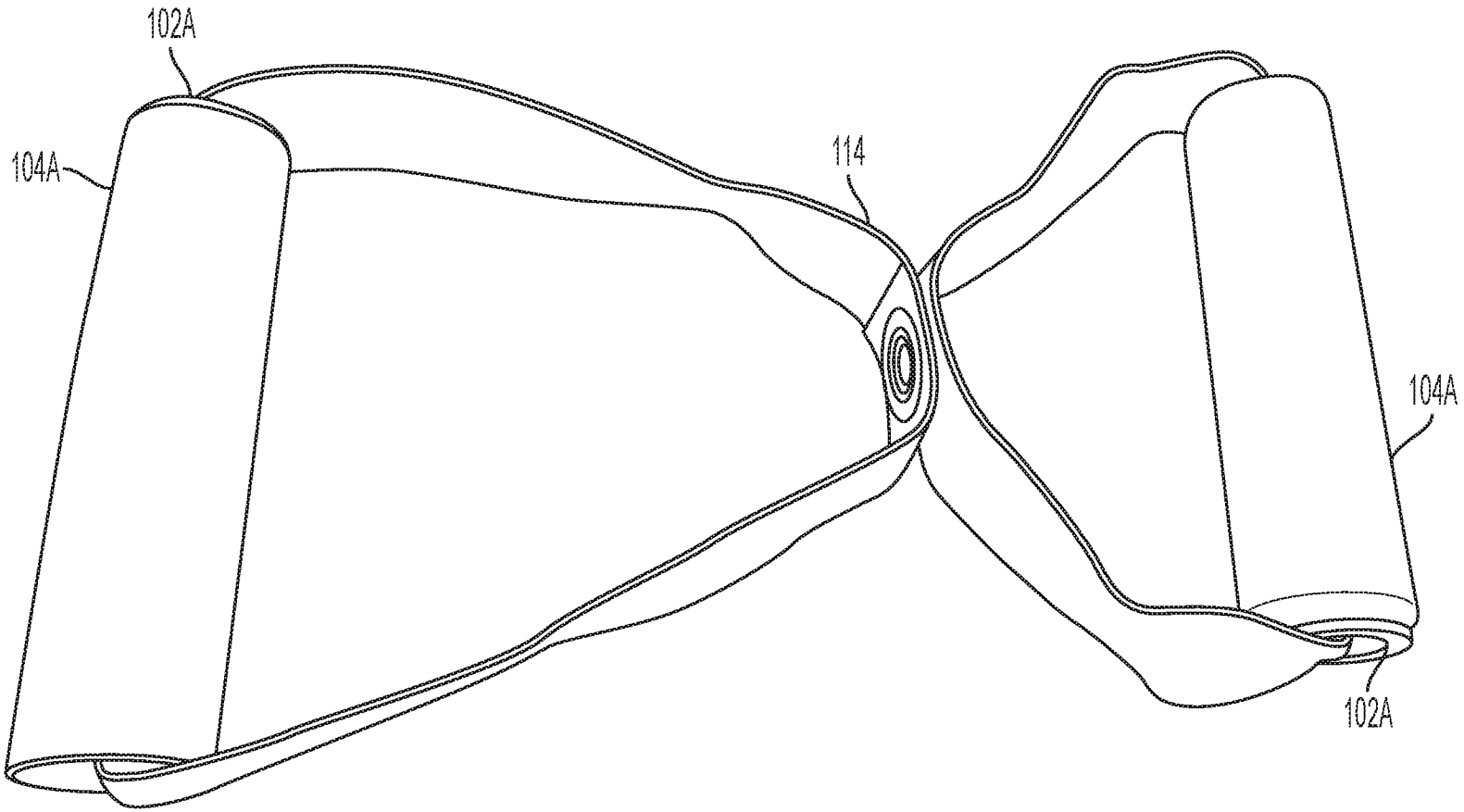

FIG. 4 is a drawing showing a pair of handles separated from one another and showing relative lengths of each strap made of material such as nylon or other strong material. A typical length of the strap to the outer handle is 15 cm and a typical length of the strap to the inner handle is 11 cm in a side by side arrangement as in FIG. 1A. A metal O-ring grommet ties the two strap ends of each handle together and permits passage of the elastic resistance loop and covering material through to be plugged as shown in FIG. 1B by plug 105. In an embodiment of FIG. 1E, the straps 106, 107 will be of equal length between D ring and handle, for example, a strap having a value between 11 and 15 cm.

Figure 5:
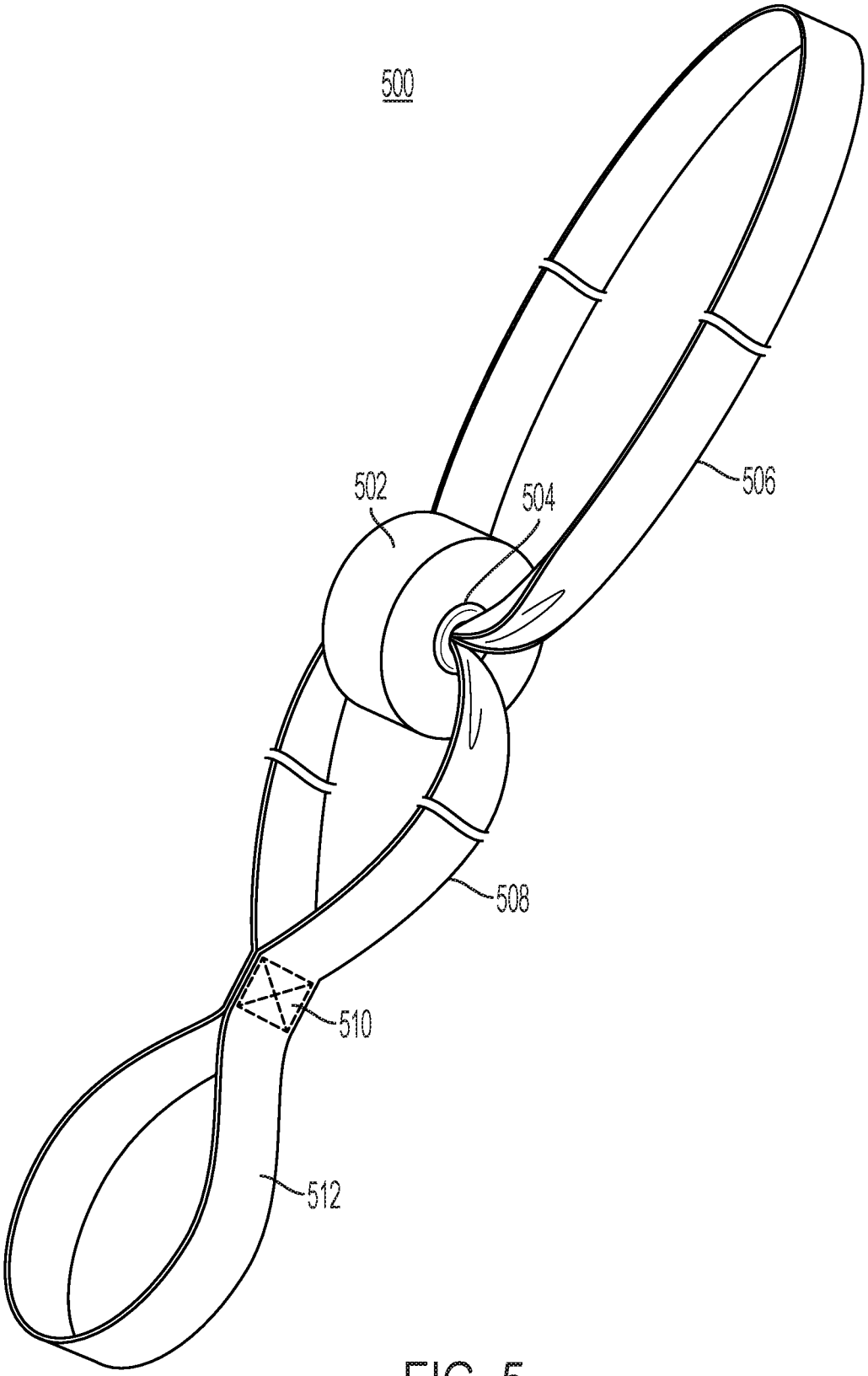

FIG. 5 is a drawing of a door attachment embodiment according to the present invention for exercise equipment (for example, FIG. 1A) of the present invention where loop 512 may be placed around a door handle or door knob and stitched by stitching 510 to a second loop 508 of varying size which passes through a, for example, plastic spindle 504 having a foam rubber cylinder cover useful as a protective door stop 502. Thus, if the door handle fails, the door stop 502 should stop the door attachment from passing through a door opening releasing exercise equipment attached to it so an exerciser does not get hurt by stretched elastic tubing 110 release. The varying size may simply reach from the door handle to a closed door side. It may reach to the floor or it may reach to the top of the closed door. Loop 506 must pass through the closed door and simply reaches to the outside of the closed door for receiving the stretching exercise loop with two handles at each distal end of FIG. 1A or FIG. 3 through the loop. Since doors may be of varying thickness and height, the loop 506 may be of varying length. Attaching the door attachment to a door handle or knob can prevent serious accidents such as if the door opens by accident or the door stop were to break or the loop be released from the door handle.

Figure 6:
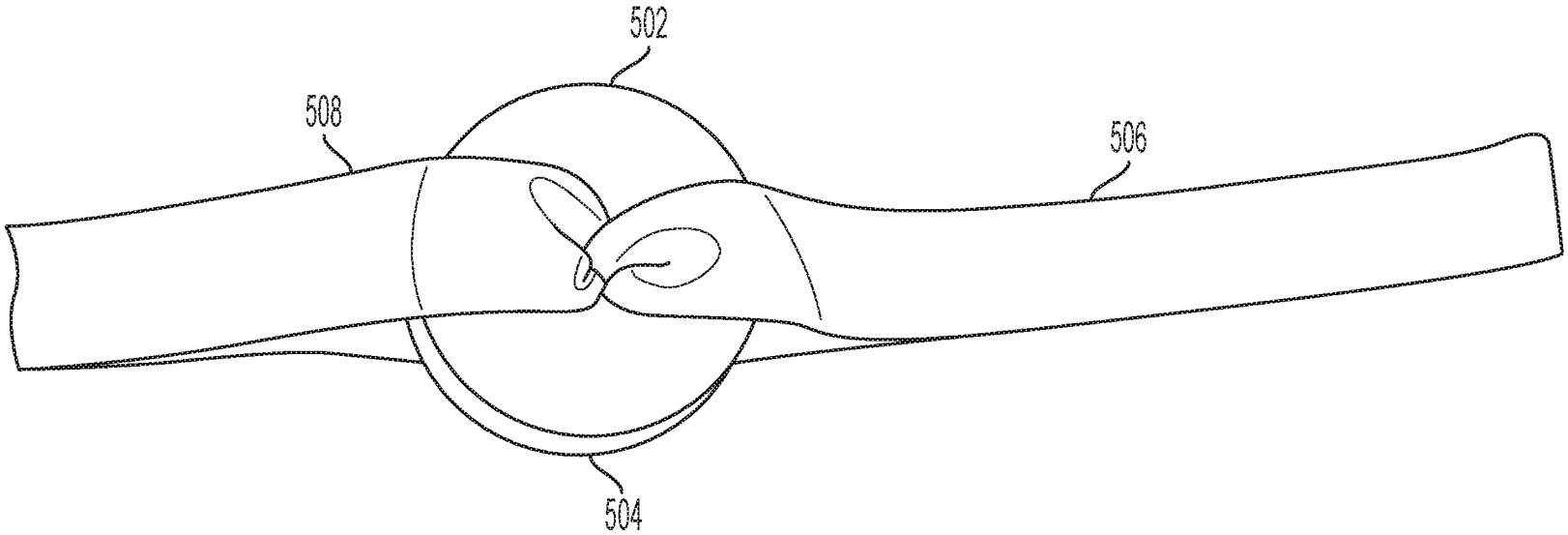

FIG. 6 provides exemplary dimensions for the door attachment of FIG. 5. The plastic spindle/foam stop 502 may have a diameter of 6 cm (range of 2.5 to 10 cm) and a thickness of 2.5 cm (approximately one inch, range of 2 to 5 cm). The length of strap 506 for reaching around a closed door may be approximately 16 cm in length (range of 10 to 25 cm) and between 1.0 to 2.75 cm in width. Dual loop 508, 512 may be of sufficient length to reach from the door handle to the side, top or bottom of a closed door where loop 512 may be of sufficient length to match the circumference of a door knob or reach around the support for a door handle or knob for safety purposes.

Figure 7:
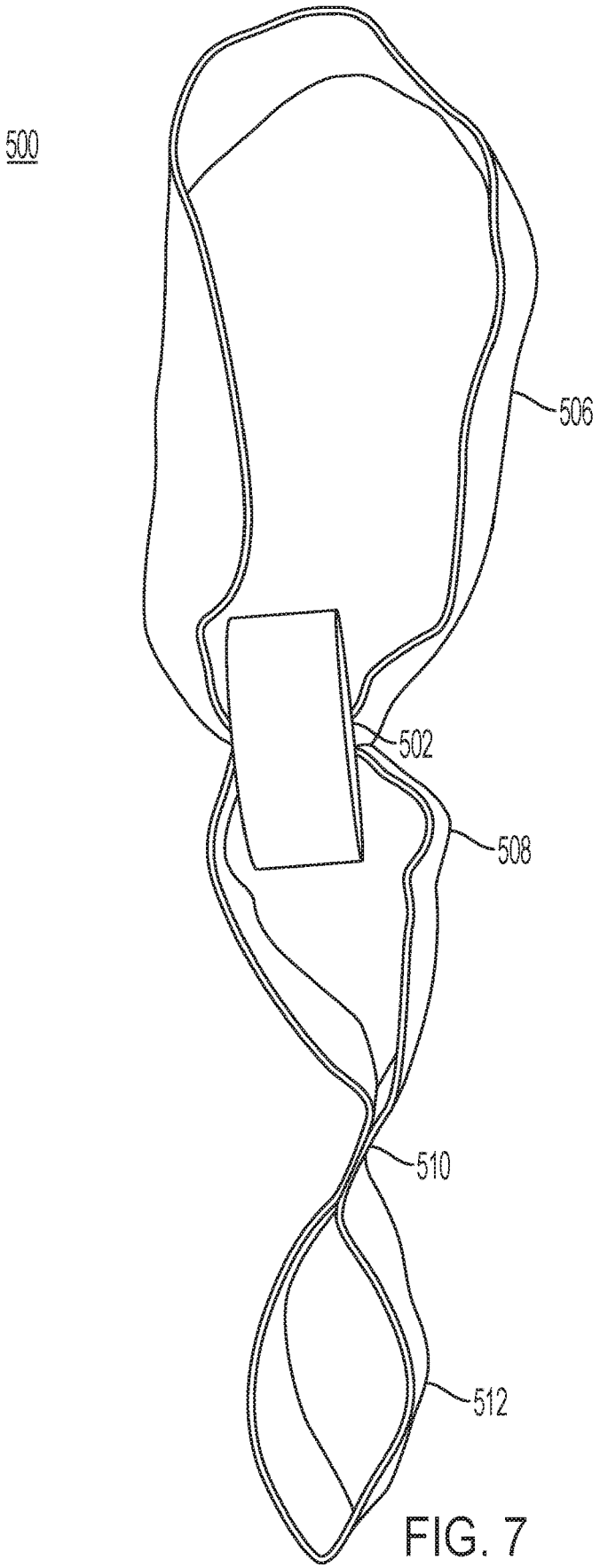

FIG. 7 provides a further example of the door attachment of FIG. 5 showing material loop 506, spindle/foam door stop 502, reaching strap 508 of material and door handle or knob strap 512 of material with stitching 510 separating loops 508 and 512.

Figure 8:
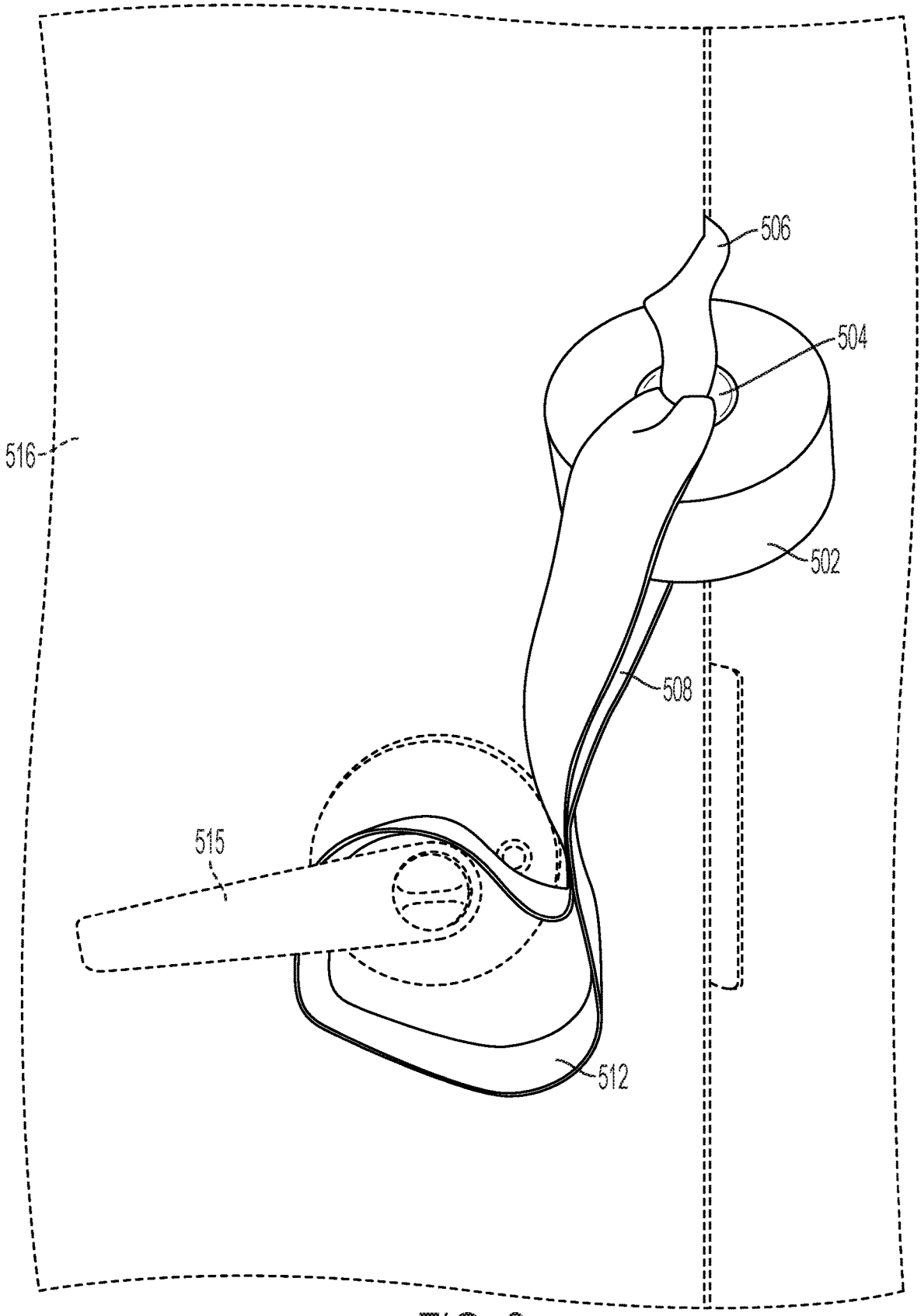

FIG. 8 shows a closed door in dashed line wherein the loop 512 of material is placed around the door handle 515 (or door knob) for safety. Loop 512 is intended to fit securely around the door handle 515. Loop 508 leads to cylindrical door stop comprising spindle 504 and foam cylinder 502 and a portion of loop 506 is seen going through a closed door to reach the other side of the closed door 516. As described before loop 506 should be sufficiently long to reach, not just around the door at waist height but also, may reach the top of the door and the bottom of the door for certain exercizes.

Figure 9:
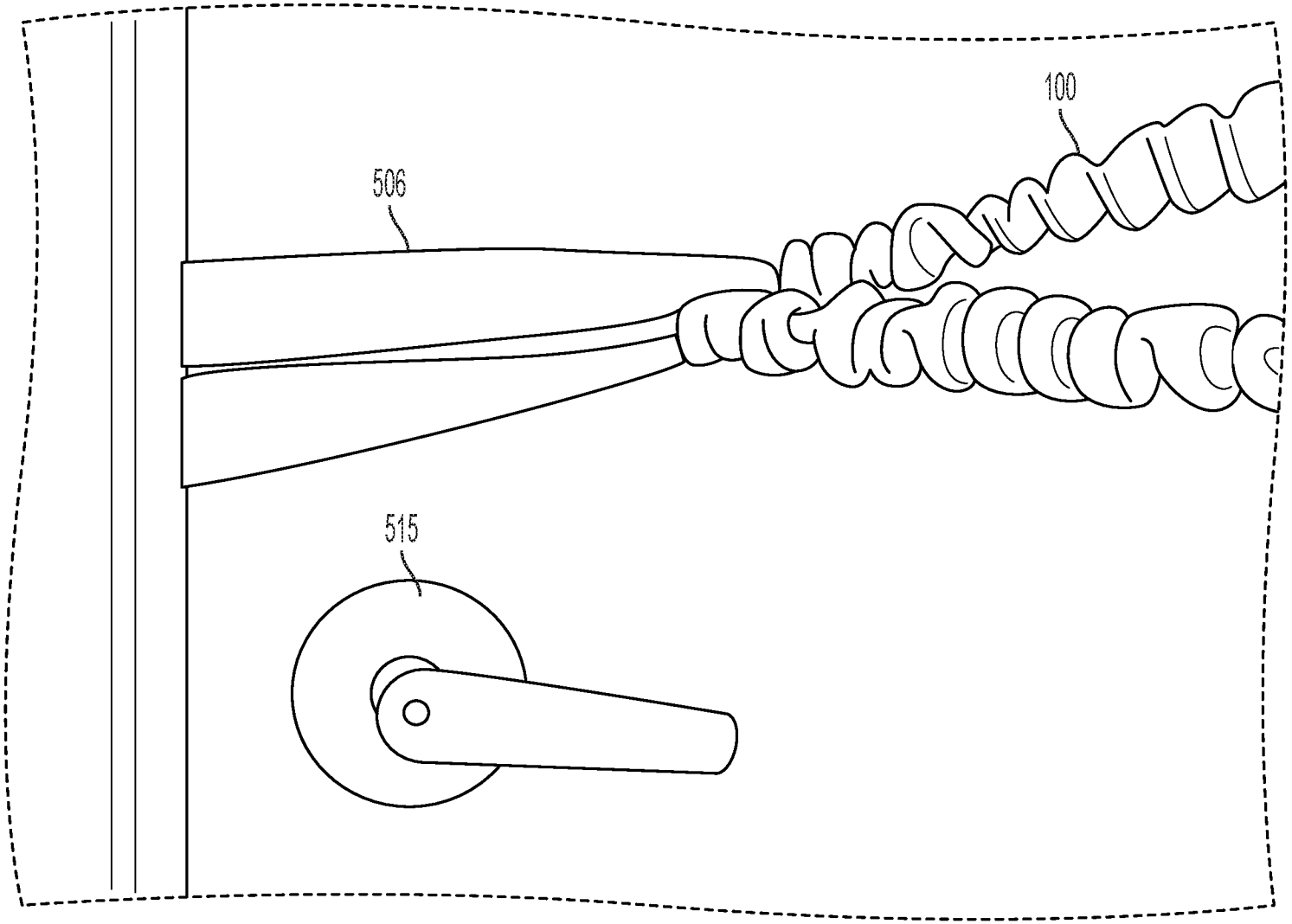

FIG. 9 shows the other side of the closed door of FIG. 8 where loop 506 is at waist height and has been threaded with the material/elastic loop of stretching exercise equipment 100 of FIG. 1A or FIG. 3. The door handle 515 (or knob, not shown) is not used on this closed side of the closed door. In other embodiments as discussed above, the loop 506 may reach around the top of the door or the bottom of the door.

Figure 10:
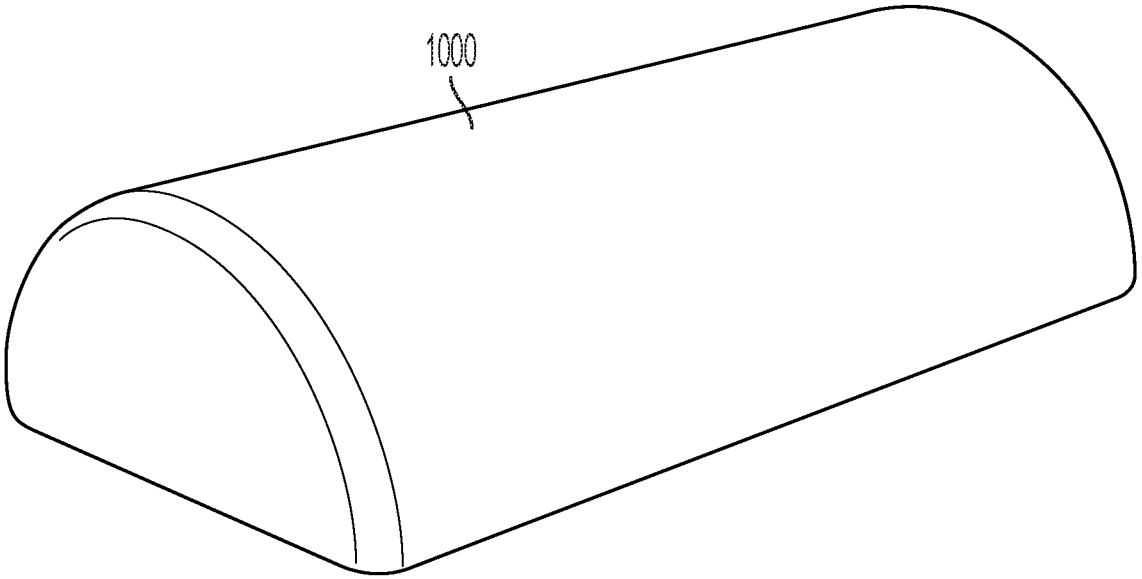

FIG. 10 is a semi-circular cross-section semi-cylindrical support which may be referred to as a half foam roller for use, for example, in a reverse bridge exercise with the roller located under the back and so comprise a body support in the reverse bridge or a support for one's legs in another exercise and the like.

Figure 11:
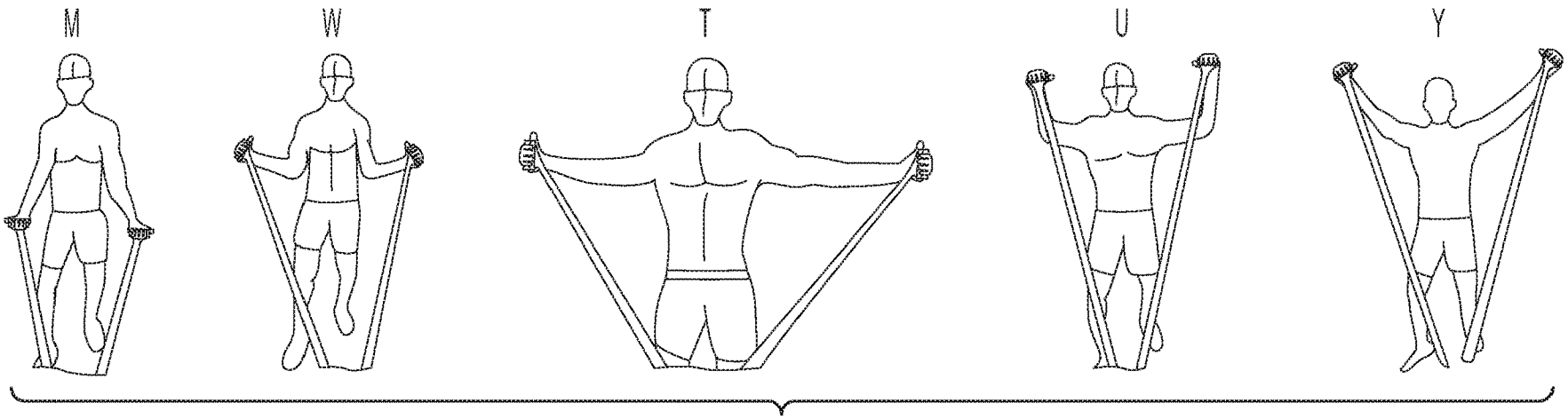

FIG. 11 provides a plurality of pulling holds for use with the double handle exercise equipment of FIGS. 1A and 3. In each of positions M, W, T, U and Y, it is assumed that the double-handled stretching equipment of FIG. 1A or FIG. 3 is looped through a closed door loop (per FIGS. 8 and 9) to a handle of the door or door knob via the door attachment of FIG. 5 at door handle (or knob) level, top of door level or bottom of door level. Position M shows a position where the stretch is from one's hands positioned at one's sides forming an M. Position W shows a position where the stretch has moved to one's elbows with shoulders close to the body and wrists and arms extending at ninety degrees from the body (forming a W). Position T shows pulling with the arms fully extended (forming a T). Position U shows the arms at right angles with grips and wrists pointed up from horizontal shoulders and upper arms (forming a U). Position Y shows a pulling position with the upper arms forming a letter Y with the torso. In all pulling positions, the body is facing the closed door or wall. For example, one may pull or release for approximately seven pulls or releases (range between one and fifteen) (preferably seven times) and hold the position for ten seconds (within a range of three seconds to thirty seconds) but preferably about ten seconds and then release.

Figure 12:
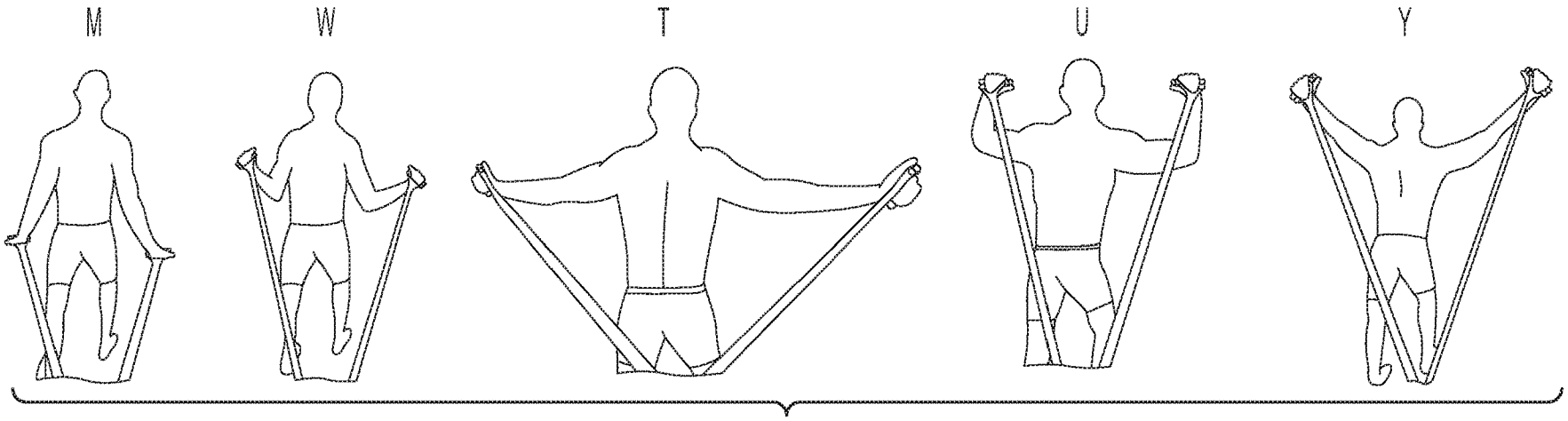

FIG. 12 shows pushing positions similar to pulling positions of FIG. 11 but with one's back to the closed door or wall. Double handles are not shown but are intended to be shown. Otherwise, positions M (arms down), W (forearms raised), T (arms stretched to the side), U (forearms raised forming a U) and Y (arms raised forming a Y) are similar to those of FIG. 11 but are pushing positions and then release (behind one) toward the door (or wall). As before, the nylon material 108 of the stretching equipment of FIG. 1A or 3 limits the stretch of the elastic tubing 110 and so prevents the elastic tubing 110 from breaking when stretched and limits the amount of pushing to an isometric stretching exercise. As above, for example, one may push or release for approximately seven pulls or releases (range between one and fifteen) (preferably seven times) and hold the position for ten seconds (within a range of three seconds to thirty seconds) but preferably about ten seconds and then release.

Figure 13:
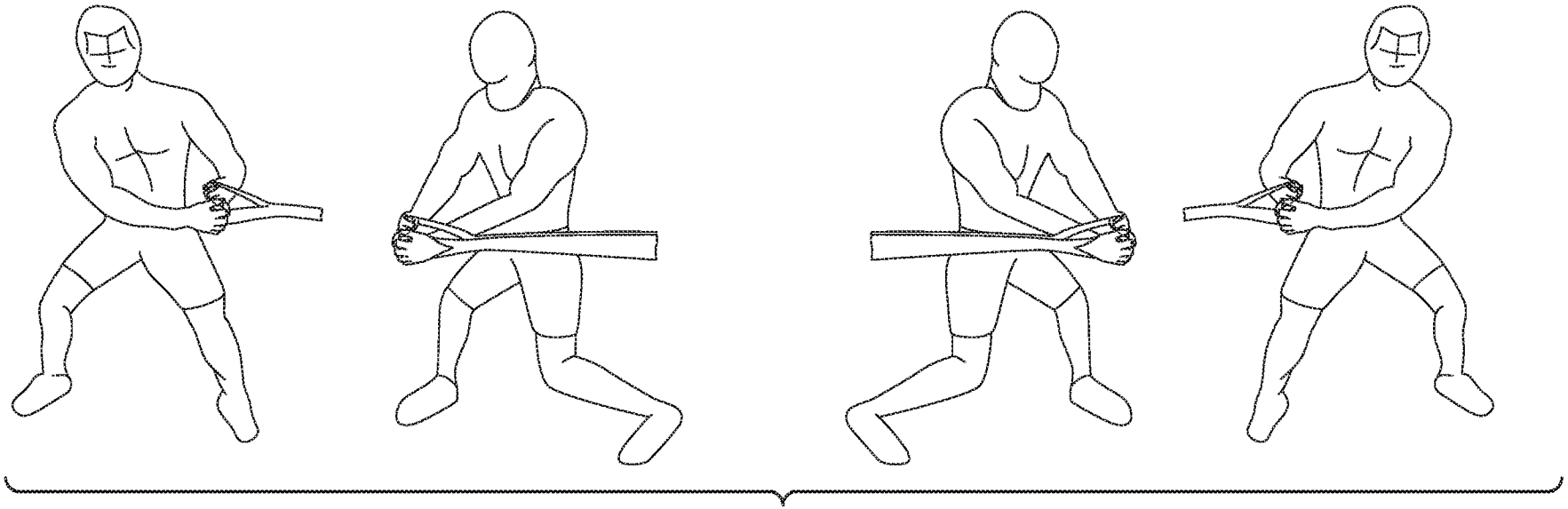

FIG. 13 shows right and left trunk rotation positions (similar to pulling positions) with feet at approximately ninety degrees to one another intended to show double handles where the exercise equipment is that shown, for example, in FIG. 1A and FIG. 3 but with one's body having one's back orthogonal to the closed door or to a wall with a protective door stop per FIG. 5 or a known bracket (not shown for supporting the material/rubber tubing portion at the halfway point). Trunk (Right) shows one pulling with both hands on the double handle from the closed door or wall at Start to far from the closed door or wall at Finish. Trunk (Left) is the opposite being started and finished to the left of the closed door or wall where start from close to the wall or closed door to Finish at far from the closed door or wall. Otherwise, trunk positions right and left are similar pulling holds to those of FIG. 11 but are pulling positions with one's back perpendicular to a closed door (using a protective loop and stop of FIG. 5 or a known wall bracket). The nylon material covering 108 limits the stretch of the elastic tubing 110 as described above and so prevents the tubing from breaking when stretched and limits the amount of stretching to an isometric stretching exercise. For example, one may pull or release for approximately seven pulls or releases (range between one and ten sets) (preferably seven times) and hold the position for ten seconds (within a range of three seconds to ten seconds) but preferably about seven seconds and then release. Similar positions, not shown, for pulling, pushing and trunk rotation may be performed from a sitting position, on a first knee, on the other knee, and kneeling on both knees.

The drawings FIGS. 1A through 13 and those of the priority ornamental design patent applications may be subject to law of copyright and be registered at the Copyright Office as having been created in 2018 by the present inventor and will now be discussed in detail in the following detailed description of embodiments and uses of the present invention.

DETAILED DESCRIPTION

In the figures of the present embodiments of the invention, an effort has been made to follow a convention such that the first reference number such as IXX indicates a figure number where the element first appears, for example, where exercise equipment 100 comprises material covering 108 covering an elastic resistance tubing 110 plugged by plug 105, all first appearing in FIG. 1A except tubing 110 first seen in FIG. 1B.

Figure 1D:
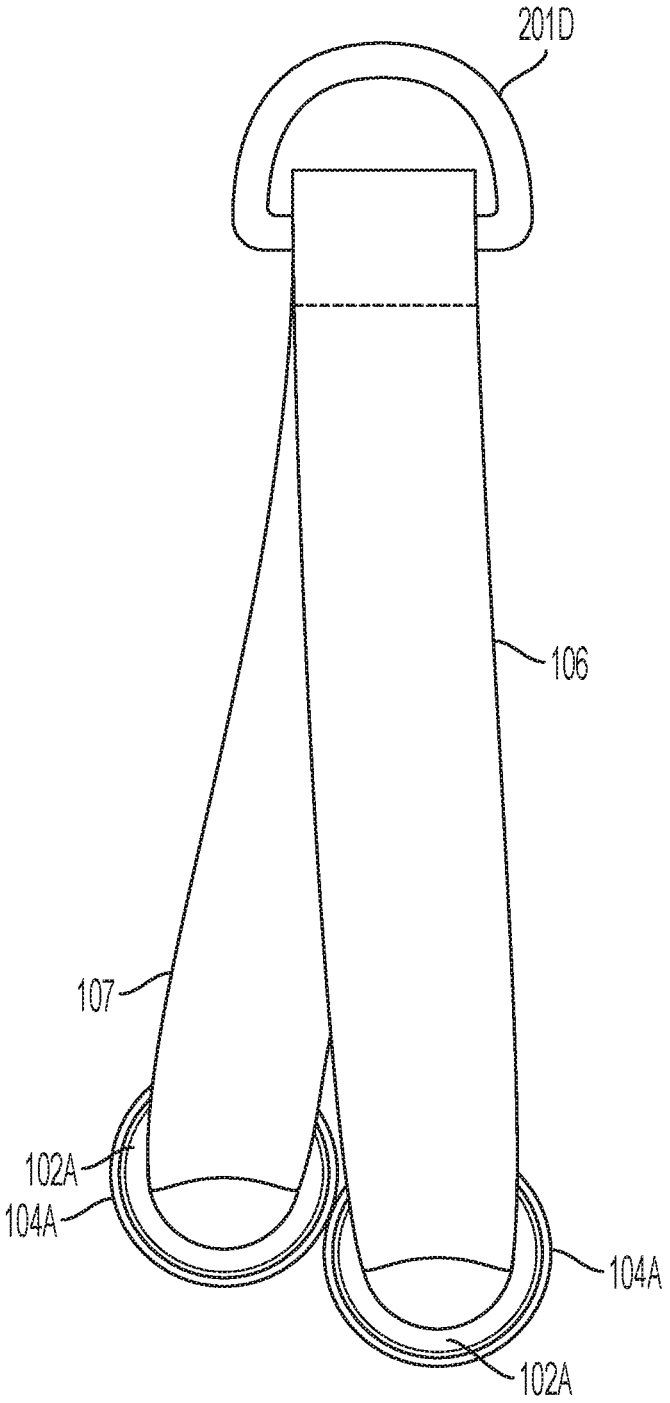
FIG. 1D shows out-of-alignment handles which may be of different diameter where 102A may represent plastic material and 104A may represent a foam rubber cover for gripping. As already described, straps 106 and 107 are shown out of alignment in this figure and a D-ring clasp 2010 for attachment to other exercise equipment using, for example, a carabiner.
Figure 1E:
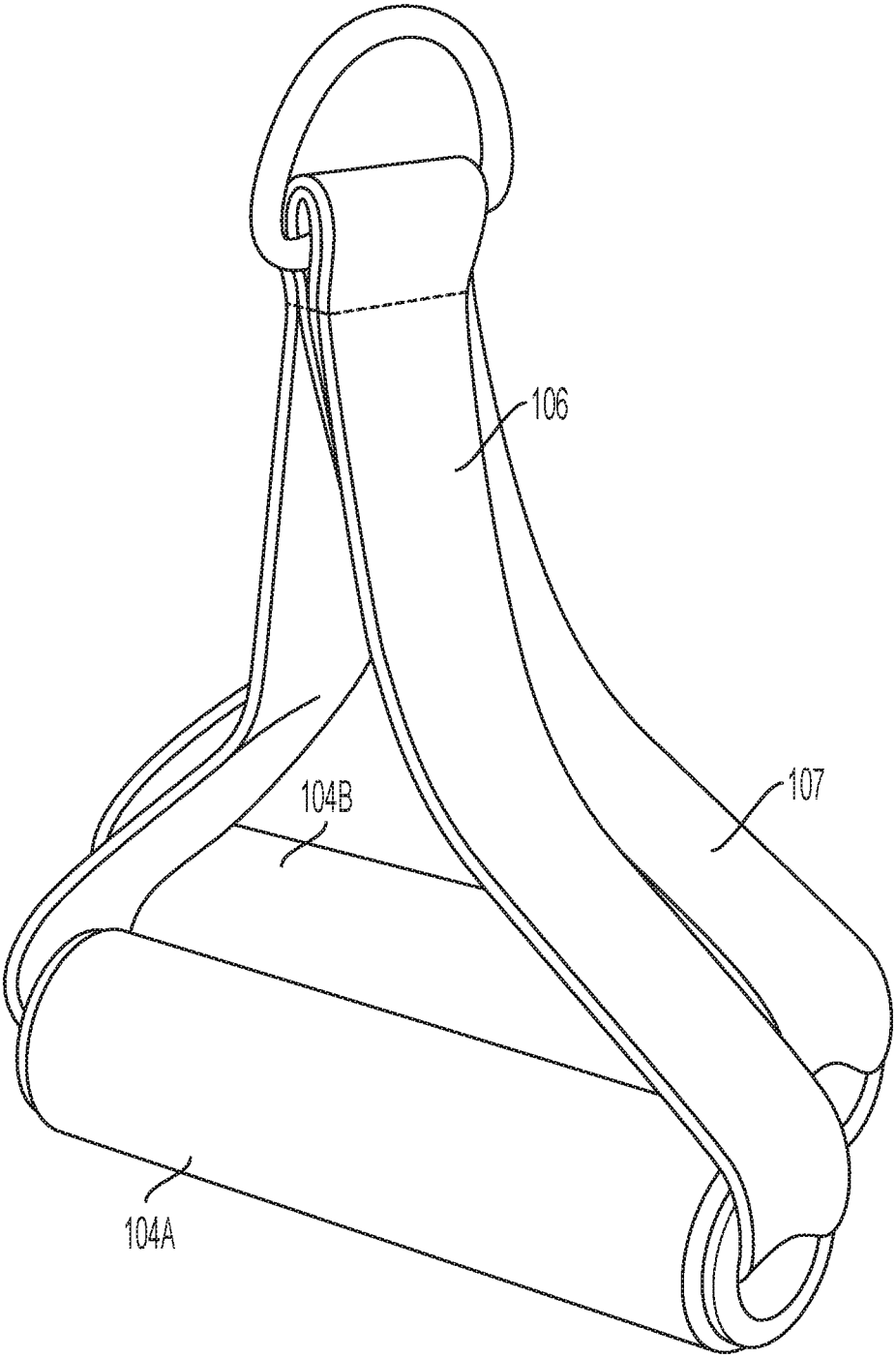
FIG. 1E shows side-by-side foam rubber surfaced handles 104A and 104B that are orthogonal to the direction of the D-clasp to exercise equipment. As already suggested, the handles may be of different diameter. For example, a larger diameter handle may be placed closer to the thumb while the smaller diameter handle may be placed closer to the fingers and the combination roll when firmly gripped.

FIG. 1A through FIGS. 1E, 2, 3 and 4 are directed to a description of the construction of an elastic tubing exercise device having first and second distal ends for tying and plugging a first handle or grip comprising a central plastic cylinder 102A and an outer foam covering 104A to a second handle or grip comprising a plastic cylinder 102B and an outer foam covering 104B, each of the two grips at one distal end of elastic tubing having a material covering 108 passing through the grip handle for limiting the extension of the elastic tubing 110 (see FIG. 1B). One strap to one handle may be shorter than the other strap or the same length to the other handle (see FIGS. 1C through 1E, showing handles in alignment, at an angle to one another, and perpendicular to the direction of pushing or pulling) so that a user may firmly grip both grips together simultaneously causing the grips to rotate slightly with respect to one another as the user strengthens their grip on the two handles (having a foam rubber cover) together at each distal end of the material covering/elastic tubing 108, 110. In so gripping, the double handles may rotate slightly with respect to one another, clockwise or counterclockwise as the handles are squeezed together during exercise. Moreover, while all handles are shown with the same diameter handles, different diameter handles may be employed to advantage, not only for children's use but for adult use where one handle is intentionally of greater diameter than the other handle (not shown). For example, one handle may have a ¾ inch diameter and the other handle a 1¼ inch diameter where the larger diameter handle may be placed close to the thumb and the smaller diameter handle closer to the four fingers. Sizes will vary for different sized hands. It is not useful for the fingers and thumb to overlap one another. An object is that one hand is to firmly grip two handles together to cause the exerciser to use greater hand, wrist, forearm, shoulder, rotator cuff and scapula muscles during the exercises.

Referring now to FIG. 1A, FIG. 1A provides a top right perspective view of the elongated exercise equipment of one embodiment of the present invention comprising first and second handles 102A, 104A and 102B, 104B (double the typical number of handles) at each distal end of the plugged material covering 108 (for example, of nylon or other strong material) for elastic tubing 110 having variable length as indicated by the break in material covering 108. A typical length of the material covering 108 or elastic tubing 110 at rest is between fifty inches and seventy-eight inches with a preferred length of sixty inches. In a preferred use with a door, the exercise equipment of FIG. 1A or FIG. 3 is looped through a protective strap having a door stop and a loop around a door handle to protect the user from the exercise equipment breaking free from the door and hurting a user. The material covering 108 may extend and limit the stretched length of the elastic tubing. When used with a door attachment (FIG. 5) whose use is exemplified in FIGS. 8 and 9, the overall length to each arm of a user would be from twenty-five inches to thirty-nine inches (thirty inches preferred) limited by the stretching of material covering 108. So that at rest, a preferred length is thirty inches of unstretched material covering 108 and elastic tubing 110 to each of the user's hands each grasping the double handles firmly. A user may stand approximately between three and four feet (range of three to ten feet) from a closed door and perform exercises shown, for example, in FIGS. 11, 12 and 13, for healing, for rehabilitating injuries such as a torn rotator cuff and/or for increasing strength.

FIG. 1A is a drawing of an embodiment of exercise equipment having double handles at each end of an elastic tubing 110 (see FIG. 1B) surrounded by a flexible material 108 which may pass through a metal O-ring grommet (see grommet 114 of FIGS. 1A-1) and holes in strap ends (strap ends 106, 107 of FIG. 1C of different length straps). Each strap 106, 107 passes through each of a pair of, for example, plastic cylindrical handles 102A, 102B, each handle having a compressible foam rubber covering 104A, 104B which may be $1/16^{th}$ inch to $1/8^{th}$ inch thick (range of $1/16^{th}$ to ¼ inch thick). FIG. 1A includes a dashed line circle representing FIG. 1A-1 which provides details of a plug 105, the O-ring grommet 114, strap ends 106, 107 and elastic tubing 110 inside material covering 108, for example, of nylon.

FIG. 1B is a drawing intended to show the elastic tubing 110 which may be designed to accommodate varying degrees of force such as from three pounds to fifty pounds of strength within its range of extension and may be approximately 1.25 centimeters diameter (within a range of 1.0 to 1.5 centimeters) and fits inside material covering 108 as seen in FIG. 1A combined with FIG. 1B. The material covering 108 and elastic tubing 110 inside are bent together on the handle side of an O-ring metal grommet and plugged by plug 105.

FIG. 1C shows detail of overlapping strap ends 106 and 107, which are in alignment with one another, each strap end having a hole for receiving an O-ring metal grommet 114 (not shown), D-ring 115 shown, the O-ring being punched into place, while the D-ring may be attached by a carabiner to known exercise equipment such as weight machines. Plug 105 of FIG. 1 and overlapping material covering 108 and elastic tubing 110 (shown bent over in FIG. 1B) bent over to prevent the material and tubing from pulling through the grommet 114 because of the pinching of plug 105. FIG. 1C shows in alignment double handles while FIG. 1D shows handles at an angle to one another and FIG. 1D shows side by side handles 106 and 107. As discussed about, the double handles may be of different diameters or the same diameters, just smaller or larger diameters, for children versus adult use. It is important that a hand and the double handles be sized so that the double handles may be firmed grasped together without the fingers overlapping the thumb to assure that the user may grasp the double handles firmly with one or both hands, depending on how they are used.

FIG. 1D shows out-of-alignment handles which may be of different diameter where 102A may represent plastic material and 104A may represent a foam rubber cover for gripping. As already described, straps 106 and 107 are shown out of alignment in this figure and a D-ring clasp 2010 for attachment to other exercise equipment using, for example, a carabiner.

FIG. 1E shows side-by-side foam rubber surfaced handles 104A and 104B that are orthogonal to the direction of the D-clasp to exercise equipment. As already suggested, the handles may be of different diameter. For example, a larger diameter handle may be placed closer to the thumb while the smaller diameter handle may be placed closer to the fingers and the combination roll when firmly gripped.

FIG. 2 is a drawing of an exemplary handle grip comprising a plastic (or related material) inner cylinder 102 and an outer covering cylinder 102 of foam rubber (or rubber or other squishable material) 104 that compresses when gripped. Each handle grip may be between 2.0 and 2.75 centimeters in diameter depending on whether the user is young and has a small hand or is older or larger and has a large hand and grip or may have different diameter handles for firm gripping by the thumb and four fingers (without overlapping). The object is to grip both handle grips together at each distal end in order to squeeze the foam rubber or other squishable material covering 104 to a compressed state, and the grips may rotate together slightly in a clockwise or counterclockwise direction as the user tightens/loosens their grip. The wider grip than a prior art single handle multiplies the compression and strength of the grip in combination with the compression of the foam rubber (or other covering material) 104.

The hand shown to the left in FIG. 3 in dashed line at the left distal end of a stretching band 108 and is one of two hands intended to be used with the exercise device of FIG. 1A in pushing and pulling and covering elastic tubing 110. Elastic tubing material 110 (FIG. 1B) covered by, for example, nylon material 108 are shown in FIG. 3. The dash-lined hand comprises a wrist, four fingers and a thumb for gripping the two handles together, compressing the foam rubber or other covering 104. When the hand grasps both handles (shown in alignment), the thumb and four fingers may compress the foam rubber covering of each cylinder together so that a left handle rotates counter-clockwise and a right handle rotates clockwise (or vice versa). When the wrist and fingers are more active, the left handle may be squeezed against the right handle so that the left handle rotates clockwise while the right handle rotates counter-clockwise (or vice versa). The thumb may overlap the fingers or not, (preferably not overlap), depending on the size of the hand and the diameter of each handle grip. There would be a loss in gripping strength if the fingers overlap the thumb or vice versa. Each handle may be sized for each user and range in diameter from 1.5 to 3.5 cm, for example, 1.5 centimeters for young people having small hands to 3.5 centimeters for large people having large hands. A preferred diameter for most people may be 2.5 centimeters including the foam covering 104. The diameters of each handle of the two handle pair need not be the same as explained above where the handle closer the thumb may be of larger diameter than the diameter of the handle closer the four fingers.

FIG. 3 is a drawing showing a side view of the exercise equipment of FIG. 1A showing a dashed line hand and wrist and fingers gripping two handles of FIG. 2 positioned side-by-side and attached to elastic tubing/material covering 110, 108 at each distal end (left side hand shown). The double-handled grip extends and strengthens the grip formed by the thumb and four fingers, wrist, forearm, elbow (not shown), shoulder (not shown), rotator cuff and scapula and activates muscles in the torso (core muscles) such as scapular muscles (unlike the prior art), multiplying the resistance capable by using a single grip handle known in the art. Note that the straps of FIG. 3 reaching through each of the two handle grips at one distal end will have different lengths so that the two grip handles may be positioned one next to the other and may be squeezed together compressing the foam 104 of each handle. Further discussion of the grip handles in relation to one another are described with reference to FIGS. 1C to 1E showing D-ring connection by a carabiner of double handles according to the invention to other known exercise equipment such as weights.

Referring now to FIG. 4, a handle is manufactured by forming a plastic cylinder 102A having a diameter sufficient for passing a strap and a width sufficient for grasping by a hand; (thumb and finger grips may be of different diameter). The plastic handle 102A of each handle is mostly covered by foam rubber, rubber or other squishable material having a sufficient thickness to be compressed. Each end of a strap is passed through a handle and has a hole for receiving an O-ring metal grommet (embodiments of FIGS. 1A and 3) which is punched into placed and flattened to hold the four ends of the two straps together as seen in FIG. 4. A typical width of a strap is from 2.0 cm to 3.0 cm to pass through the hole and be wide enough to be grasped with an O-ring metal grommet with other strap ends and form a strong attachment to both handles. A flexible covering 108 and elastic tubing 110 are passed together through each metal O-ring grommet and bent over and plugged by a plug. The flexible covering 108 limits the stretch of the elastic tubing 110 for both safety purposes and because the exercises described below are not intended to be strenuous, but rather be more isometric and fatiguing, for example, to increase rotator cuff and scapula stability such as in pulling or pushing exercises using the double handle stretching exercise equipment embodiments of the present invention.

FIG. 4 is drawing showing a pair of handles separated from one another and showing relative lengths of each strap made of material such as nylon or other strong material. A typical length of the strap to the outer handle is 15 cm (range of 12 to 18 cm) and a typical length of the strap to the inner handle is 11 cm (range of 8 to 14 cm. A typical length of a handle is slightly larger than the typical width of a hand, for example, 10 to 15 cm wide. Typically, the straps overlap and may be adjacent to one another (but of different length) so that the foam portion 104 of each grip may be compressed, and their length is also determined by the diameter of each handle grip including foam covering 104 and whether a side-by-side, angular or orthogonal design is preferred; (see FIG. 1C to FIG. 1E). A metal O-ring grommet 114 ties the two strap ends 106, 107 of each strap end together and permits passage of the elastic resistance loop 110 and covering material 108 through to be plugged as shown in FIG. 1C by plug 105.

FIGS. 5 through 9 provide drawings of a safe door attachment that may be used with the double-handled elastic band and flexible material of FIG. 1A and FIG. 3. FIG. 5 is a drawing of a typical door attachment embodiment according to the present invention for exercise equipment of the present invention where loop 512 may be placed around a door handle and stitched by stitching 510 to a second loop 508 of varying size which passes through a, for example, plastic spindle 504 of a foam cylinder 504 useful as a door stop. The varying size of a tie loop 508 may simply reach from the door handle receiving safety loop 512 to a closed door side. A typical door handle may be only three inches from the door and the door may only be about one and a half to two inches thick so to reach the other side of the door (allowing about two inches), the combined loops 512, 508 may be about eight inches long within a range of seven to twelve inches (or more to reach and pass through the top or bottom of a closed door). It may reach to the floor (about three feet three inches) or it may reach to the top of the closed door (for example, four feet from the door handle). Loop 506 may pass through the closed door and simply reach to the outside of the closed door, in typical use, for receiving the stretching exercise loop with two handles at each distal end of FIG. 1A passing through the loop. Since doors may be of varying thickness and height, the loop 506 may be of varying length.

FIG. 6 provides exemplary dimensions for the door attachment of FIG. 5. The spindle/foam stop may have a diameter of 6.0 cm (range of 2.5 to 10 cm) and a thickness of 2.5 cm (approximately one inch) (range of 1 cm to 5 cm). The length of strap 506 for reaching around a closed door to exercise equipment may be approximately 16 cm in length (unless it is reaching the top or bottom of the closed door from the door handle or knob). Dual loop 508, 512 must be of sufficient length to reach from the door handle (or knob) to the side, top or bottom of a closed door where loop 512 must be of sufficient length to match the circumference of a door handle/knob or reach around the support for a door handle/knob.

FIG. 7 provides a further example of the door attachment of FIG. 5 showing loop 506, spindle/foam door stop 502, 504 reaching strap 508 and door handle or knob strap 512 with stitching 510 separating loops 508 and 512.

FIG. 8 shows a closed door in dashed line wherein the loop 512 is placed around the handle 515 for safety. Loop 512 should be sized appropriately for a door handle (circumference of 3 cm) or door knob (circumference between 5 and 10 cm), Loop 508 leads to cylindrical door stop comprising spindle 504 and foam cylinder 502 and a portion of loop 506 is seen going through a closed door to reach the other side of the closed door 516.

FIG. 9 shows the other side of the closed door where loop 506 has been threaded with the material/elastic loop of stretching exercise equipment 100 of FIG. 1A or FIG. 3. The door handle (or door knob, not shown) 515 is not used on this closed side of the closed door.

FIG. 10 is a figure showing a semi-circular cross-section semi-cylindrical support referred to herein as a half foam roller for use in, for example, a reverse bridge exercise to support the back or to support the legs in another exercices and may comprise a back support or support for one's legs at the knee when lying on one's back and the like.

FIG. 11 provides a plurality of pulling holds. In each of positions M, W, T, U and Y, it is assumed that the double-handled stretching equipment of FIG. 1A is looped through a closed door loop to a handle of the door via the door attachment of FIG. 5 at door handle level, top of door level or bottom of door level with the door handle level being the level most frequently used. Position M shows a position where the stretch is from one's hands positioned at one's sides to form an M. Position W shows a position where the stretch has moved to one's elbows with shoulders close to the body and wrists and arms extending at ninety degrees from the body (forming a W). Position T shows pulling with the arms fully extended (forming a T). Position U shows the arms at right angles with grips and wrists pointed up from horizontal shoulders and upper arms (forming a U). Position Y shows a pulling position with the upper arms forming a letter Y with the torso. In all pulling positions, the body is facing the closed door or wall. Pulling positions are used to pull the together handles together to reach the M, W, T, U or Y position and then hold that position for a count between seven and twelve. As indicated above, the stretch may be variable from three pounds to fifty pounds or more. For example, one may pull or release for approximately seven pulls or releases (range between one and fifteen) (preferably seven times) and hold the position for ten seconds (within a range of three seconds to thirty seconds) but preferably about ten seconds and then release.

FIG. 12 shows pushing positions similar to pulling positions but with one's body having one's back to the wall or closed door. Double handles as per FIGS. 1C to 1E are not shown but are intended to be shown with different diameter handles within the scope of the invention. Otherwise, positions M, W, T, U and U are identical to those of FIG. 12 but are pushing positions with one's back to the wall or closed door. As above, for example, one may push or release for approximately seven pulls or releases (range between one and fifteen) (preferably seven times) and hold the position for ten seconds (within a range of three seconds to thirty seconds) but preferably about ten seconds and then release.

FIG. 13 shows right and left trunk rotation positions (similar to pulling positions) with feet at approximately ninety degrees to one another intended to show double handles where the exercise equipment is that shown, for example, in FIG. 1A and FIG. 3 but with one's body having one's back orthogonal to the closed door or to a wall with a protective door stop per FIG. 5 or a known bracket (not shown for supporting the material/rubber tubing portion at the halfway point). Trunk (Right) shows one pulling with both hands on the double handle from the closed door or wall at Start to far from the closed door or wall at Finish. Trunk (Left) is the opposite being started and finished to the left of the closed door or wall where start from close to the wall or closed door to Finish at far from the closed door or wall. Otherwise, trunk positions right and left are similar pulling holds to those of FIG. 11 but are pulling positions with one's back perpendicular to a closed door (using a protective loop and stop of FIG. 5 or a known wall bracket). Only one set of double handles is used for one of Trunk (Right) or Trunk (Left). The nylon material covering 108 limits the stretch of the elastic tubing 110 as described above and so prevents the tubing from breaking when stretched and limits the amount of stretching to an isometric stretching exercise. For example, one may pull or release for approximately seven pulls or releases (range between one and ten sets) (preferably seven times) and hold the position for ten seconds (within a range of three seconds to ten seconds) but preferably about seven seconds and then release.

Similar positions, not shown, for pulling, pushing and trunk rotation may be performed from a sitting position, on a first knee, on the other knee, and kneeling on both knees.

A perfect sequence of exercises may be prescribed by a physical therapist according to use of the apparatus of the present invention for any variety of sports injuries, long-lasting pain, lack of range of motion of an arm, leg or other body part that may be diagnosed as, for example, a torn rotator cuff, a pulled hamstring, a sprained ankle or a sprained elbow or other injury. It has been demonstrated that utilizing the equipment of the present invention in combination with known equipment including weights and pulley machines and other equipment that, in a single physical therapy session, range of motion may be improved and pain reduced such that if one follows the perfect sequence of exercises over time, the patient will heal more quickly using the double handles for strengthening body muscles, for example, in the hand, wrist, elbow, shoulder and scapula than using conventional single handles.

While various aspects of the present invention have been described above, it should be understood that they have been presented by way of example and not limitation. It will be apparent to persons skilled in the relevant art(s) that various changes in form and detail can be made therein without departing from the spirit and scope of the present invention. Thus, the present invention should not be limited by any of the above described exemplary aspects, but should be defined only in accordance with the following claims and their equivalents.

In addition, it should be understood that FIGS. 1A through 13, which highlight the structure, methodology, functionality and advantages of the present invention, are presented for example purposes only. The present invention is sufficiently flexible and configurable, such that it may be implemented in ways other than that shown in the accompanying figures.

Further, the purpose of the foregoing Abstract is to enable the U.S. Patent and Trademark Office and the public generally and especially the scientists, engineers and practitioners in the relevant art(s) who are not familiar with patent or legal terms or phraseology, to determine quickly from a cursory inspection the nature and essence of this technical disclosure. The Abstract is not intended to be limiting as to the scope of the present invention in any way.

What is claimed is:

1. Exercise equipment having an elastic circular band surrounded by flexible material of a length between fifty-eight inches and seventy-eight inches, at each distal end of the elastic circular band surrounded by a flexible covering material, a first and second handle, each comprising a plastic grip handle covered by a foam rubber cover, each plastic grip handle and foam rubber cover having a diameter of between 2.0 and 3.5 centimeters, each, plastic grip handle being of sufficient length adapted for a human hand comprising four fingers and a thumb to grasp firmly, a respective first or a second strap end passing through each plastic grip handle, the strap ends comprising a first strap and a second strap, the first and second straps to each of the first and second plastic grip handles having a different length adapted such that when the plastic grip handles are gripped by a human hand, the foam rubber cover of each plastic grip handle compresses and the plastic grip handles rotate slightly with the force of the grip, each distal end of the elastic circular band and flexible covering material passing through an O-ring metal grommet tying one strap for one plastic grip handle to the other strap of the other plastic grip handle by their respective ends, and the exercise equipment being adapted to be gripped such that the foam rubber covering of each plastic grip handle compresses and may rotate slightly as a plastic grip handle is tightened around each pair of plastic grip handles.

2. Exercise equipment of claim 1, a strap between an O-ring metal grommet of one plastic grip handle being approximately 15.0 centimeters to the plastic grip handle within a range of twelve to eighteen centimeters and a strap between the O-ring metal grommet and the other plastic grip handle at one distal end of the exercise equipment being approximately 11.0 centimeters within a range of eight to fourteen centimeters.

3. Exercise equipment of claim 1, each plastic grip handle being slightly longer than the width of a hand having four fingers and a thumb.

4. Exercise equipment of claim 3, each plastic grip handle having a diameter between 2.0 and 3.5 centimeters.

5. Exercise equipment of claim 4, each plastic grip handle of two plastic grip handles at one distal end of the exercise equipment having a different diameter.

6. Exercise equipment of claim 4, each plastic grip handle of two plastic grip handles at each distal end of two distal ends of exercise equipment having equal length of a value between ten to fifteen centimeters.

7. Exercise equipment of claim 1, the flexible covering material and the elastic tubing being within a range of 56 and 78 inches in length, the material covering limiting the stretch of the elastic tubing.

8. Exercise equipment of claim 7, the elastic circular band having a diameter between 1.0 and 1.75 centimeters.

9. The exercise equipment of claim 1 for use with a door attachment, the door attachment comprising a safety strap loop for looping around one of a door knob and a door handle, and an extension loop stitched to the safety strap loop threaded through a spindle of a plastic spindle of a plastic and foam door stop, the plastic spindle and door stop forming a cylinder with a hole at its central axis further being threaded with a loop for reaching the other side of a closed door for attachment to the exercise equipment of claim 1.

10. A method of manufacturing the stretchable exercise equipment of claim 1, comprising: forming the plastic grip handle having a diameter sufficient for passing at least one of the straps therethrough and a width sufficient for grasping by the hand; mostly covering the plastic handle by the foam rubber covering having sufficient thickness to be compressed; each end of the first and second straps being passed through the plastic grip handle and having the hole for receiving the O-ring metal grommet punched into the first and second straps and placed and flattened to hold the four ends of the first and second straps together; a width of the first and second straps being from 2.0 cm to 3.0 cm to pass through the hole and be wide enough to be grasped by the O-ring metal grommet.

11. A method as recited in claim 10 further comprising passing the flexible covering material and elastic tubing together through each of first and second metal O-ring grommets; the flexible covering material and elastic tubing bent over and plugged by a plug, the flexible covering material limiting the stretch of the elastic tubing.

* * * * *